United States Patent [19]

Kang

[11] Patent Number: 4,813,309

[45] Date of Patent: Mar. 21, 1989

[54] AUTOMATICALLY CONTROLLED SOCKET WRENCH

[76] Inventor: Byung K. Kang, 1516-5 Jung 2-Dong, Pusan Eunhang Apt. #101, Haeundae-Ku, Pusan, Rep. of Korea

[21] Appl. No.: 125,164

[22] Filed: Nov. 25, 1987

Related U.S. Application Data

[63] Continuation-in-part of Ser. No. 3,835, Jan. 16, 1987, abandoned.

[30] Foreign Application Priority Data

Mar. 14, 1987 [KR] Rep. of Korea ..... 87-5352

[51] Int. Cl.[4] ..... B25B 13/00

[52] U.S. Cl. ..... 81/57.43; 81/63; 81/163

[58] Field of Search ..... 81/60, 61, 62, 63, 163, 81/165, 57.43

[56] References Cited

U.S. PATENT DOCUMENTS 1,794,614 3/1931 Hochman ..... 81/163

2,112,565 3/1938 Hare ..... 81/163

2,292,391 8/1942 Merriman et al. ..... 81/63

4,112,792 9/1978 Guimann ..... 81/163

*Primary Examiner*—Frederick R. Schmidt

*Assistant Examiner*—Maurina Rachuba

*Attorney, Agent, or Firm*—Birch, Stewart, Kolasch & Birch

[57] ABSTRACT

An automatic controlling socket wrench comprises a body having a handle, a rotating gear member including a pair of jaws which containing a plurality of racks and a worm gear, a controlling wire rope connected to the worm gear and a button, a stopper for stopping the rotating gear, and a cover for covering the rotating gear assembled with the controlling wire rope and stopper. When the button moves forward, the jaws are caused to open, and after the socket wrench is manipulated around an object, by moving to return the button and suspending the stopper, the jaws of the socket wrench are automatically and strongly closed around the object.

4 Claims, 3 Drawing Sheets

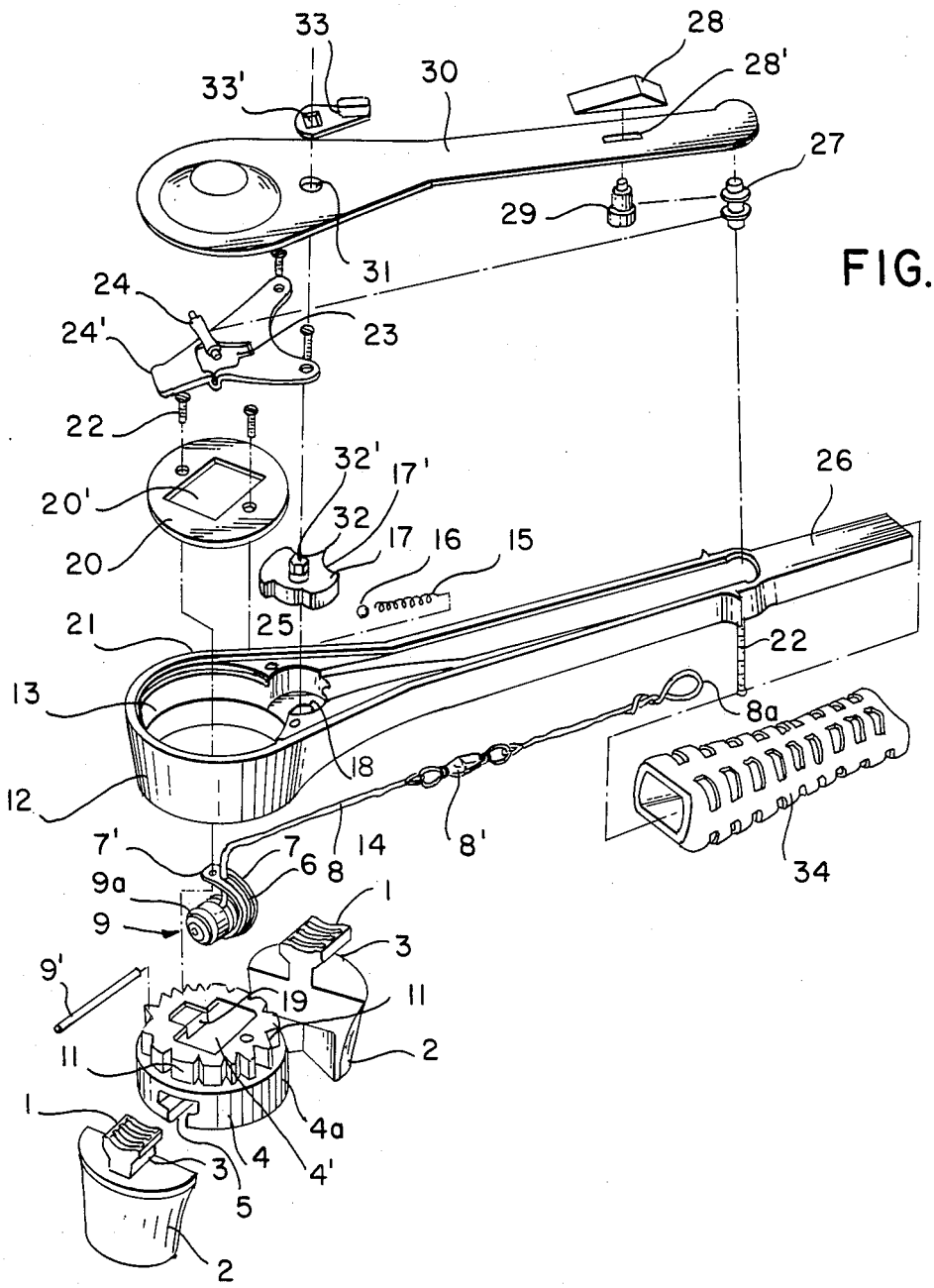
FIG. 1
FIG. 2
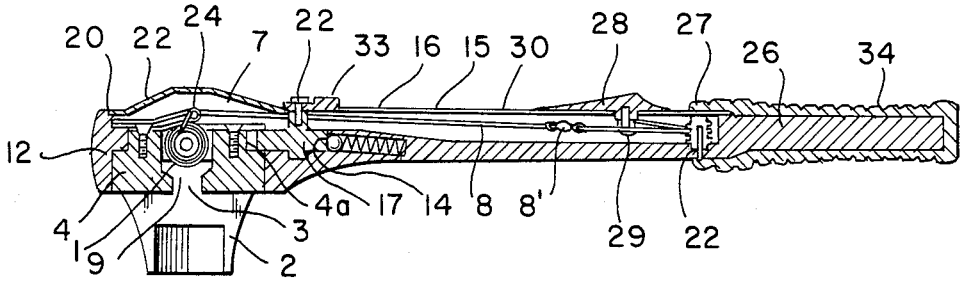

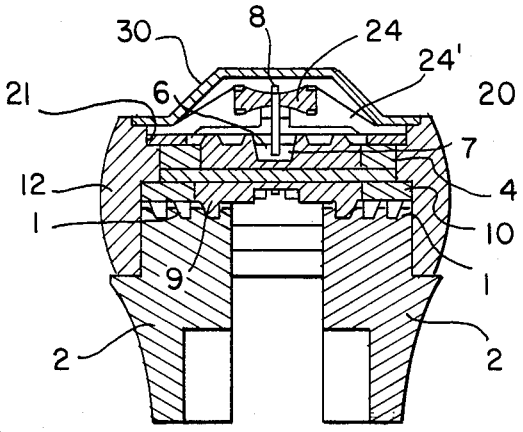
FIG. 6
FIG. 8
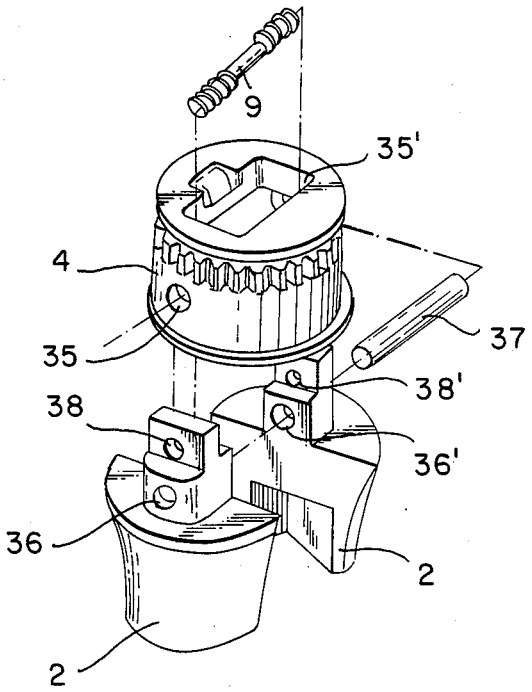
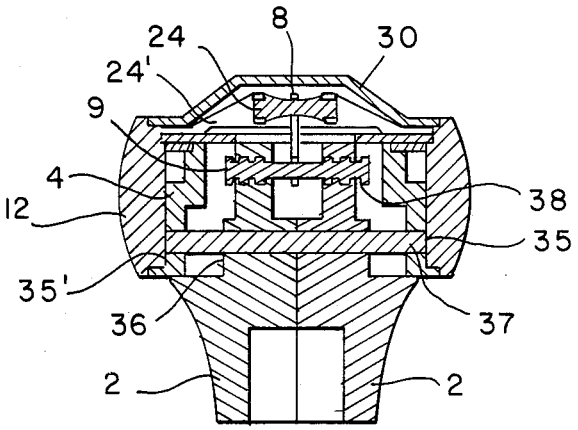
FIG. 9

AUTOMATICALLY CONTROLLED SOCKET WRENCH

CROSS-REFERENCES TO RELATED APPLICATION

This is a continuation-in-part of application, Ser. No. 003,835, filed Jan. 16, 1987, for "AUTOMATICALLY CONTROLLED SOCKET WRENCH", which is now abandoned.

FIELD OF THE INVENTION

The present invention relates to an automatically operating socket wrench and more particularly to a socket wrench having jaws which can be tightly closed around and release from an object by operating a button and utilized for any size object with little effort being required by the user.

DESCRIPTION OF THE PRIOR ART

There are many types of socket wrenches which are well known in the art which utilize a ratchet handle and various size sockets engaged to the ratchet handle. However, these wrenches suffer from a number of difficulties such as, for example, it is very difficult to select a socket which properly mates with the object to which it is applied. Also the sockets can be readily lost and are expensive to manufacture. Furthermore, in specific wrenches, such as monkey spanners, the thumb must be utilized to push a lever against the bias of a worm gear to permit the jaws of the monkey spanners to close around the desired object.

SUMMARY OF THE INVENTION

Accordingly, it is an object of the present invention to provide an automatically operating socket wrench by operating a button disposed thereon.

Another object of the present invention is to provide a socket wrench which is easy to operate and possesses a strong grasping power.

A further object of the present invention is to provide a socket wrench which can be utilized on any size object without the use of a variety of socket sizes.

Still another object of the present invention is to provide a socket wrench which can be readily locked to an object by a lever.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an automatically operating socket wrench which comprises a body having a handle, a rotating gear member including a pair of jaws which contain a plurality of racks and a worm gear, a connecting wire rope having a wire rope connected to the worm gear and a button disposed on the handle, a stopper for stopping the rotating gear, and a cover for covering the rotating gear assembled with the controlling wire rope and stopper, whereby when the button moves forward, the jaws are caused to open, and after the socket wrench is manipulated around an object, by returning the button and suspending the stopper, the jaws of the socket wrench are automatically and securely closed around the object.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is an exploded perspective view showing the basic components of the automatically operating socket wrench of the present invention;

FIG. 2 is a cross-sectional view of the automatically operating socket wrench of the present invention;

FIG. 6 is a side sectional view of the head portion of the socket wrench of the present invention showing the worm gear in an open position;

FIG. 8 is a perspective view illustrating another embodiment of the head portion of the socket wrench of the present invention; and FIG. 9 is a side sectional view of FIG. 8.

DETAILED DESCRIPTION OF THE INVENTION

Figure 3:
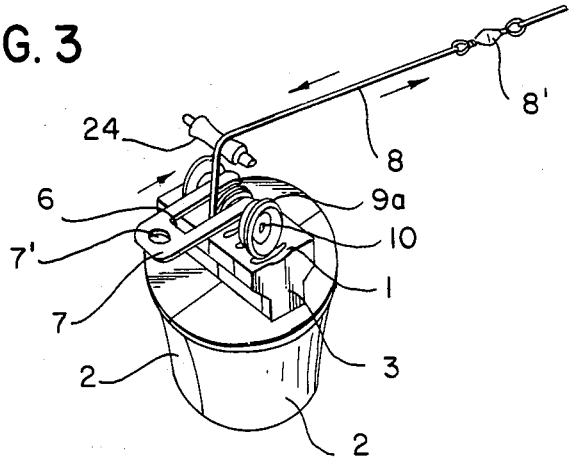
FIG. 3 is a perspective view of a head portion of the socket wrench of the present invention.

Referring now in detail to the drawings for the purpose of illustrating preferred embodiments of the present invention, the automatically operating socket wrench as shown in FIGS. 1 and 2 comprises a body member 12, a stopper 17, a rotating gear member 4, a double worm gearing member 9, a controlling wire rope 8, a cover member 30 and a handle 26 disposed at one end of the body member 12.

The body member 12 having apertures 25 is provided with a rotating gear engaging member 13, a plate engaging member 21 and a stopper engaging member 18 at the other end thereof for engaging the rotating gear member 4, the cover 30, and the stopper 17, respectively.

The rotating gear member 4 contains a rotating gear teeth **4*a*, a groove 5, a slot 19, a guiding slot 4', a spring attaching slot 19, axial apertures 11 and pin apertures 11' disposed therein. The groove 5 engages rack bodies 3' disposed on jaws 2. The rack body 3' is provided with a plurality of racks 1. Also, the jaw 2 is provided with a grasping member 2*a* for tightly grasping an object which can have any configuration. A double worm gearing member 9 having a plate spring 7 attached to a tubular shaft 10 at one end thereof. The plate spring 7 is provided with an extending hole 6 and an aperture 7' disposed at the other end thereof for inserting into the spring attaching slot 19 (FIG. 3). The tubular shaft 10 is mounted in an axial pin 9' disposed within the axial apertures 11. The axial apertures 11 are provided in the rotating gear member 4. Also, the double worm gearing member 9 contains opposite acting worm gears 9*a* disposed at opposite end positions thereof for selectively opening or closing the pair of jaws 2. The controlling wire rope 8 disposed within the body member 12 is connected to the double worm gearing member 9 at one end and a ring 8a disposed at the other end thereof. The connecting wire rope 8 includes an adjusting member 8' for controlling the length thereof. A circular plate 20 having a rectangular aperture 20' disposed at the center thereof engages in the plate engaging member 21. A roller 24 operatively wound by the controlling wire rope 8 is supported by a roller support member 24' which includes a hole 23 for passing the wire rope 8** therethrough.

The cover member 30 having an aperture 31 and a large aperture 28' for moving a bolt 29 which is attached to an actuator as a button 28. The ring 8a extended to the controlling wire rope 8 engages with the bolt 29 through a small roller 27 having a shaft 22. The stopper 17 is provided with a rectangular pin 32 for corresponding a rectangular hole 33' of a lever 33. The lever 33 is assemble to the stopper 17 by an engaging groove 18 disposed in the body member 12 together with the cover member 30 through bolts 22. Slots 17' receives a ball 16 disposed at one end of a resilient spring 15. The other end of the resilient spring 15 engages one corner of the stopper engaging member 18. The resilient spring 15 is biased against the stopper 15 (FIG. 2). The handle 26 is provided with a rough portion 25 disposed therearound for permitting the tight grasping of the handle 26.

In assembly, after the pair of jaws 2 are secured into the rotating gear member 4 by inserting the rack bodies 3' of the jaws 2 into the groove 5 of the rotating gear member 4, the double worm gearing member 9 having the plate spring is assemble with the rotating gear member 4 which includes the pair of jaws 2 by sliding the axial 9' into axial apertures 11 and the tubular shaft 10. Thereafter, the assembly containing the rotating gear member 4, double worm gearing member 9, wire rope member 8 and the stopper 32 with the resilient spring 15 is inserted into the body 12, and the circular plate 20, roller support member 24', and cover member 30 is attached to the body 12 containing the rotating gear member 4 and wire rope member 8 by securing the bolt 34 into an aperture 35 disposed in the body member 12 through the aperture 32' disposed in the rectangular pin 32 of the stopper 17 and the aperture 31 disposed in the cover 19 as shown in FIG. 2.

Figure 4:
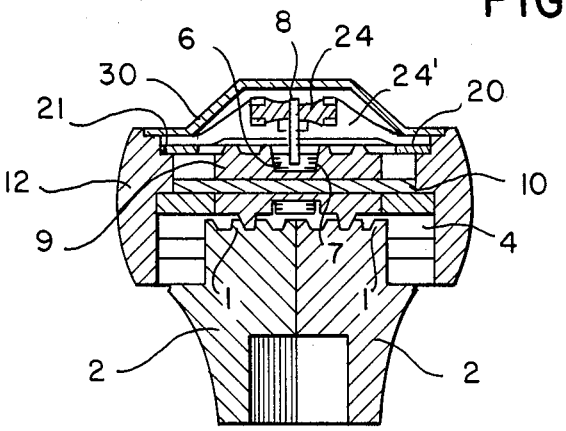
FIG. 4 is a side sectional view of the head portion of the socket wrench of the present invention showing a worm gear in a closed position.
Figure 5:
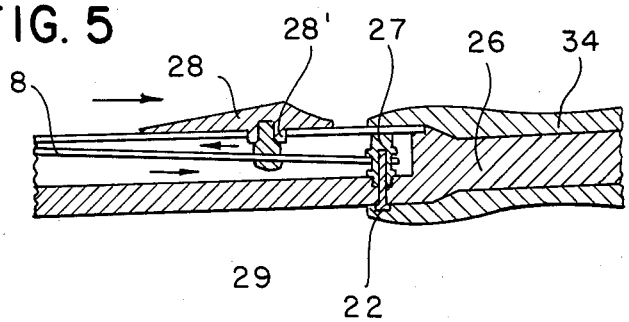
FIG. 5 is a sectional view of a button portion of the socket wrench of the present invention with the button in a position before it operates.

FIGS. 4 and 5 show a sectional view of the head portion and button portion of the assembly containing all of the components of the socket wrench of the present invention wherein the jaws 2 are in a closed position. When the button 28 does not operate, that is, not move forward, the controlling wire rope 8 does not pull against the bias rotating the double worm gearing member 4.

Figure 7:
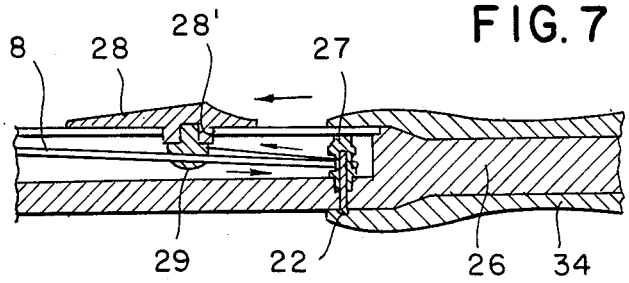
FIG. 7 is a sectional view of a button portion of the socket wrench of the present invention with the button in a position after it operates.

As shown in FIGS. 6 and 7, when the button 28 is pushed to move forward, the double worm gearing member 9 rotates in the clockwise direction and causes the worm gears 9' of the coaxial double worm gearing member 9 to rotate. The double worm gears 9' of the double worm gearing member 9 engage with the plurality of racks 1 disposed on the rack bodies 3' of the jaws 2, whereby the jaws 2 are opened. As shown in FIG. 3, the jaws 2 of the socket wrench of the present invention can be easily manipulated around any size object. Also, by operating the button 28, the jaws 2 of the socket wrench are automatically and strongly closed around the object, no matter what its size. At this time, by operating the lever 33 which the user decides to conveniently work, the resilient spring 15 is suspended to one side direction. By working the wrench, the object is rotated to be tightened or loosen only toward the suspended direction.

Referring in detail to FIGS. 8 and 9, there is illustrated an additional embodiment of a socket wrench in accordance with the present invention. The rotating gear member 4 is provided with an aperture 35 and the jaws 2 is provided with apertures 36 disposed at the top portion thereof, which receive a rod 37 for assembling the rotating gear member 4 and jaws 2. The top portion of the jaws 2 include a screw aperture 38, respectively for engaging the double worm gearing member 9. Also, the connecting wire rope 8 is connected to the double worm gearing member (FIG. 9). Therefore, the socket wrench of the present invention as shown in FIGS. 8 and 9 is operated by moving the button 27.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An automatically operating socket wrench which comprising:

a body member containing a handle, a rotating gear member disposed within said body member, said rotating gear member containing a guiding slot and a spring attaching slot disposed in the center thereof and rotatably mounted therein, said rotating gear member also being provided with a groove which extends across the bottom surface thereof, a double worm gearing member disposed in said guiding slot and, containing a tubular shaft, said double and worm gearing member containing opposite acting worm gears disposed at opposite end portions thereof, a bias plate spring means attached to said spring attaching slot at one end and to said tubular shaft at the other end thereof, said bias plate spring means being provided with an aperture disposed in the center thereof, opposing jaw members slidably mounted within said groove and extending from said body member, said jaw members containing rack means which operatively engage with the respective opposite acting worm gears of the double worm gearing member for selectively opening and closing said opposing jaw members, a stopper member disposed in said body member, said stopper member being adapted to engage said rotating gear member for restricting its rotation with said body member through the operation of a lever, and a connection means connected to said tubular shaft of the double worm gearing member at one end through said aperture in the plate spring means through rollers and at the other end to an actuator, whereby upon the operation of the actuator, the jaw members are caused to open against the bias of the plate spring means, and after the jaw members are positioned around an object and after the operation of the lever for suspending of the stopper member, the jaw members are automatically and strongly closed by the plate spring means around said object.

2. The socket wrench of claim 1 wherein the double worm gearing member is rotatably mounted to the rotating gear member by a pin means through the tubular shaft.

3. The socket wrench of claim 1 wherein the opposing jaw members are provided with grasping members disposed therein for tightly closing around an object.

4. The socket wrench of claim 1 wherein a cover member is provided for covering the rotating gear member.

* * * * *